United States Patent [19]

Schwarze

[11] Patent Number: 4,538,436

[45] Date of Patent: Sep. 3, 1985

[54] PIPE BENDING MACHINE WITH BENDING MANDREL

[76] Inventor: Rigobert Schwarze, Olpener Str. 460-474, 5000 Köln 91, Fed. Rep. of Germany

[21] Appl. No.: 542,068

[22] Filed: Oct. 14, 1983

[30] Foreign Application Priority Data

Oct. 15, 1982 [DE] Fed. Rep. of Germany ..... 3238264

[51] Int. Cl.[3] ..... B21D 9/05

[52] U.S. Cl. ..... 72/8; 72/32; 72/150

[58] Field of Search ..... 72/1, 3, 4, 8, 9, 26, 72/31, 32, 35, 36, 150; 73/862.54, 862.58

[56] References Cited

U.S. PATENT DOCUMENTS

| | | | |
|---|---|---|---|
| 2,108,746 | 2/1938 | Erichsen | 72/431 X |
| 2,887,914 | 5/1959 | Zeunert et al. | 72/1 |
| 4,380,917 | 4/1983 | Uchida et al. | 72/150 X |

FOREIGN PATENT DOCUMENTS

| | | | |
|---|---|---|---|
| 1950413 | 4/1971 | Fed. Rep. of Germany | 72/4 |
| 2732046 | 7/1977 | Fed. Rep. of Germany . | |
| 2832980 | 7/1978 | Fed. Rep. of Germany . | |
| 1308641 | 2/1973 | United Kingdom | 72/4 |
| 1597121 | 9/1981 | United Kingdom | 73/862.58 |

*Primary Examiner*—E. Michael Combs
*Attorney, Agent, or Firm*—Michael J. Striker

[57] ABSTRACT

A pipe bending machine has a travelling carriage, a bending template, a bending mandrel arranged in a pipe to be bent near the bending template and having a mandrel rod, a cylinder-piston unit for withdrawing the mandrel, and a measuring device associated with the mandrel rod and arranged to actuate in the event of overloading of the mandrel rod a switch element so as to stop or eliminate the overloading of the mandrel or the mandrel rod.

19 Claims, 5 Drawing Figures

PIPE BENDING MACHINE WITH BENDING MANDREL

BACKGROUND OF THE INVENTION

The present invention relates to a pipe bending machine with a travelling carriage having a clamping sleeve, a bending template with a clamping jaw and an adjacent slide roll, and a bending mandrel arranged in a pipe to be bent in the region close to the bending template and having a mandrel rod at its head end.

During cold bending of pipes, a mandrel rod is used in many cases so that during bending the round inner crosssection of the pipe is obtained or continuously maintained. Also for bending of two pipes insertable into one another, for example such as disclosed in the DE-OS No. 2,732,046 of the same inventor, bending mandrels are used.

Bending mandrels which act in the region of the bending template and the slide rail are mounted on a mandrel rod which has a smaller cross-section as the bending mandrel. The mandrel rod is connected with a piston of a cylinder-piston unit which displaces the mandrel rod with the mandrel for bending and after bending withdraws the same.

The pipe to be bent on a pipe bending machine is displaced for loading the pipe bending machine via the mandrel and the mandrel rod, and it is not always guaranteed that it is rectilinear. For example, individual pipes can be slightly curved which in many cases results in damaging during the transportation.

Many pipes are produced in such a way that they are bent from a metal sheet strip to a pipe and then welded in a longitudinal direction. The welding seam is in many cases dimensioned so that no subsequent treatment is needed to remove inwardly or outwardly projecting material of the welding seam. It is however not excluded that the parts of the welding seam extend inwardly and thereby lead to a narrowing of the inner pipe cross-section.

Pipes which are not straight or pipes in which a part of the welding seam projects inwardly make more difficult the passage of the pipe over the bending mandrel. Since this passage is performed by a machine, it often happens that the inner cross-section of the pipe reduced by bending or by a welding seam not only upsets the mandrel rod during passage of the abutments of the mandrel on the inwardly projecting pipe wall resulting in the reduction of the pipe cross-section, but instead in many cases it is so bent by upsetting that it becomes unuseable and must be exchanged by another mandrel rod. Since during bending of the mandrel rod in many cases the pipe cannot be displaced over the mandrel rod while the pipe feeding still takes place, it is not included that in addition to the bending of the mandrel rod further damages can take place.

In connection with this it is also possible that the pipe provided with the reduced pipe cross-section displaces over the mandrel of the mandrel rod, but leads to such damages of the mandrel rod pipe by bending that first during bending of the pipe on the bending template it can be recognized, for example by the way in which after bending the withdrawal or prior to bending the displacement of the mandrel via the mandrel rod becomes difficult or completely impossible.

When a pipe is bent over the bending templates, the subsequent pipe bends are in many cases produced in another bending plane. For attaining this, the pipe is turned prior to the bending. During this rotation the bending mandrel remains in the pipe. When for the above-mentioned reasons the pipe cross-section is reduced at certain locations, the reduced pipe cross-section can also lead to clamping of the mandrel on the inner wall of the pipe with the result that during rotation of the mandrel because of the clamping sleeve of the travelling carriage, the mandrel rod is subjected to the action of torsion which extends beyond the plastic region of the mandrel rod and can lead to a permanent deformation of the mandrel rod and also to a torsion breakage. A damage to the mandrel or to the mandrel rod or resulting subsequent damages in parts of the pipe bending machine, for example in the mandrel withdrawal means and the like, are especially serious for pipe bending machines which operate automatically, for example, with automatic loading for bending and withdrawal of the bent pipes from the pipe bending machine in a fully-automatic manner, such as disclosed in the DE-OS No. 2,832,980 of the same inventor. In such bending machines with automatic loading and automatic withdrawal even small deformations of the bending mandrel over its mandrel rod exceeding a certain tolerance can lead to a strong hindering of the programmed course.

SUMMARY OF THE IVENTION

Accordingly, it is an object of the present invention to provide a pipe bending machine which avoids the disadvantages of the prior art.

More particularly, it is an obejct of the present invention to provide a pipe bending machine which guarantees that its bending mandrel or a mandrel rod carrying the same cannot exceed an adjustable tolerance limit.

In keeping with these objects and with others which will become apparent hereinafter, one feature of the invention resides, briefly stated, in a pipe bending machine which has a travelling carriage with a clamping sleeve, a bending template with a clamping jaw and an adjacent slide rail, a bending mandrel arranged in a pipe to be bent in a region near the bending template, a mandrel rod mounted on the head end of the mandrel, a mandrel withdrawal device including a cylinder-piston unit arranged at the rear end of the mandrel rod, wherein in accordance with the present invention the mandrel rod is provided or connected with a measuring device which in the event of an overloading of the mandrel rod actuates a switch element which stops or eliminates the overloading of the mandrel.

In the pipe bending machine in accordance with the present invention, when a loading of the mandrel rod exceeds beyond an adjustable value, every measure is taken to eliminate a continuous loading of the mandrel rod.

The steps to be taken can be different depending upon which loading results in an overloading of the mandrel or the mandrel rod carrying the same. When for example the overloading of the mandrel or the mandrel rod takes place because of overdisplacement of the pipe to be bent over the mandrel, this overdisplacement is stopped with the result that the overloading discontinues. Then the pipe which is not suitable for bending is automatically withdrawn from the bending machine by the device which is built in the machine, or alternately is processed by the machine so that it can be withdrawn by hand from the bending machine.

When the overloading of the mandrel or the mandrel rod is a result of the rotation of the pipe, the rotation is then stopped. Subsequently, every steps are taken which are needed to withdraw from the bending machine the pipe which is not suitable for bending or in some cases after elimination of the distortion to proceed with bending.

The inventive proposal to provide the mandrel rod with measuring means is especially advantageous in practice when the mandrel rod at its rear end is connected or provided with a measuring device. This measuring device can determine the axial loading of the mandrel rod and stop or eliminate the same via the switch element. This measuring device can also determine separately or additionally the rotary or torsion load of the mandrel rod and stop or eliminate the same via the switch element.

The signals obtained during overloading of the mandrel rod can be introduced into a computer control of the pipe bending machine, so that in the program control for the event of an overloading of the mandrel rod, respectively provided or required steps can be taken depending upon the respective reason. Therefore, in addition to the elimination of damage to the mandrel rod, also respective subsequent damages can be avoided.

It is especially advantageous when in accordance with another feature of the present invention the rear end of the mandrel rod is supported in a housing which is provided with at least one cylinder-piston unit for measuring the force applied on the mandrel rod. This solution incorporates both features, namely that the housing of the measuring device simultaneously supports the mandrel rod and the loading from the mandrel rod is transferred to the cylinder-piston unit, so that the measuring value is hydraulically determined or fixed. The solution to transfer the overloading of the mandrel rod to the piston of the cylinder-piston unit has first of all the advantage that by the hydraulic fluid arranged in the cylinder in connection with the respective valves a first bending can take place so that the piston in the cylinder-piston unit acts and can act as a shock damper for an overloading of the mandrel rod. Thereby when because of an overloaded pipe during overdisplacement on the mandrel rod, an excessively great axial pressure is applied, it can be electrically absorbed by yielding of the mandrel rod or the piston in the cylinder chamber. Simultaneously through the pressure adjusted in the cylinder chamber, the force can be measured which corresponds to the damage-free deformation of the mandrel rod in its elastic or plastic region.

The adjustment of the pressure can be regulated by pressure valves which are known in industry. Thus, in dependence on the cross-section and/or material properties and the length of the mandrel the force can be adjusted so that when it is exceeded the steps are taken for protection of the mandrel rod and other machine elements.

In accordance with a further inventive feature, the piston includes a front portion which extends outwardly beyond the housing and is connected with the mandrel rod, and a rear portion which extends into a cylinder chamber connected with a pressure source and is provided with a sensor which cooperates with a switch arranged in the housing. It is especially advantageous when the sensor extends in a radial direction on the piston and cooperates with for example contactless and switch.

The above described piston which support at its front side the mandrel rod and extends with its rear side into the cylinder chamber determining the loading, is designed in accordance with still a further feature of the present invention so that in its central region a radially extending element is arranged and associated with two pistons of the cylinder-piston unit extending in a radial plane at two opposite sides. When the pipe bending machine is designed in accordance with these features, the housing which measures and evaluates the axial displacement on the piston rod simultaneously provides the measuring device for measuring the rotary or torsion load of the mandrel rod and thereby several loads can be measured or determined in the housing.

It is especially advantageous when the pistons at their ends facing toward the associated cylinder chambers are formed with increased diameter, and each cylinder chamber is correspondingly stepped and has two different diameters.

Still another feature of the present invention is that on the piston for the axial movement and the rotary movement of the mandrel rod a single measuring pin is provided which cooperates with a contactless end switch. The contactless end switch is provided with a surface located in the radial plane of the piston and the associated inclined surfaces, similarly to a broken edge.

In accordance with an additional feature of the present invention the housing at its end facing away from the mandrel rod is provided with a holder for the piston rod of the mandrel withdrawing device formed as a cylinder connected with the piston rod.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
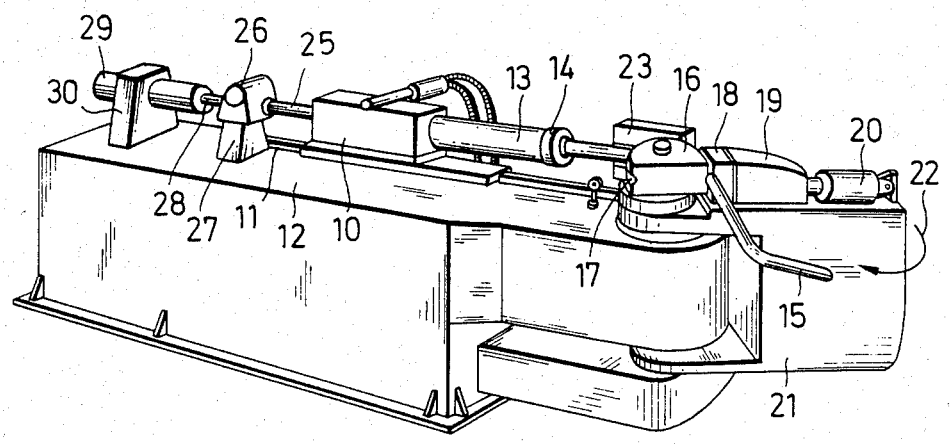
FIG. 1 is a view schematically showing a pipe bending machine in accordance with the present invention, with a mandrel.
Figure 2:
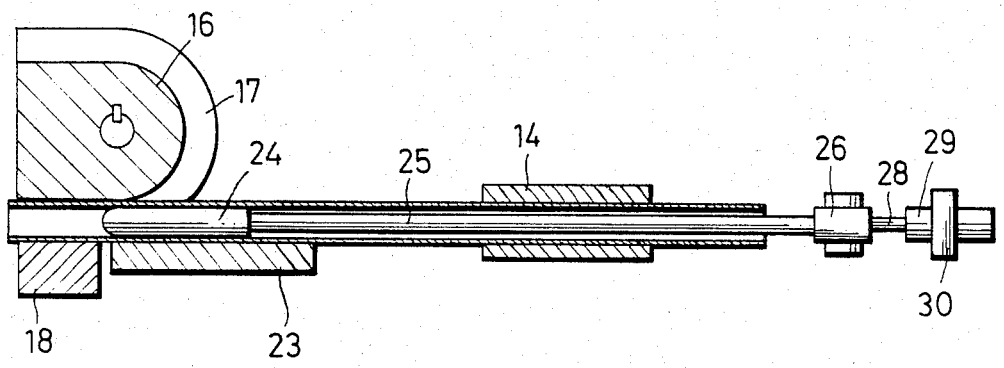
FIG. 2 is a plan view of parts of the inventive bending machine, required for bending with the bending mandrel.

FIG. 1 shows a pipe bending machine which has a travelling carriage 10 reciprocating on one or several guide rails 11 provided on the upper side of the machine housing 12. The travelling carriage 10 with the pipe cylinder 13, and a clamping sleeve 14 is located in the interior of the pipe cylinder 13 and clamps a pipe 15 to be bent. The pipe 15 is guided around a turnably supported bending template 16 which has a recess 17 corresponding to half of the pipe diameter.

The pipe 15 is pressed via a clamping jaw 18 against the bending template. The clamping jaw is actuated at a clamping arrangement 19 via a hydraulic cylinder-piston unit 20. Both these elements are arranged on a turnable table 21 which can be turned in a direction of the arrow 22. Reference numeral 23 identifies a slide rail.

A mandrel 24 is arranged inside the pipe 15 in the region of the bending template and the slide guide. A mandrel rod 25 is mounted on the front end of the mandrel 24. The mandrel rod is supported on a measuring housing 26 which is provided with a foot 27 and supported reciprocatably on the rail 11 in a axial direction of the pipe to be bent. The measuring housing 26 is mounted on a piston rod 28 of a hydraulic cylinder-piston unit 29. The structural elements 28 and 29 are used for withdrawal of the mandrel. They are supported on a standard 30. It is to be understood that the above described pipe bending machine also has guides for moving the traveller carriage 10 as well as the measuring housing 26 or the standard 30 transverse to the longitudinal direction of the pipe to be bent, so as to provide for adaptation to the bending radius of the template 16.

It should be mentioned that the solution described hereinbelow can not only be used on mandrel and be secured for overloading which takes place during bending of an individual pipe, but two pipes telescoped into one another can also be bent in correspondence with the DE-OS No. 2,732,046. In this case, the measuring housing receives two mandrel rods, wherein each individual mandrel rod can be provided with an associated measuring device to avoid overloading by upsetting end torsion.

Figure 3:
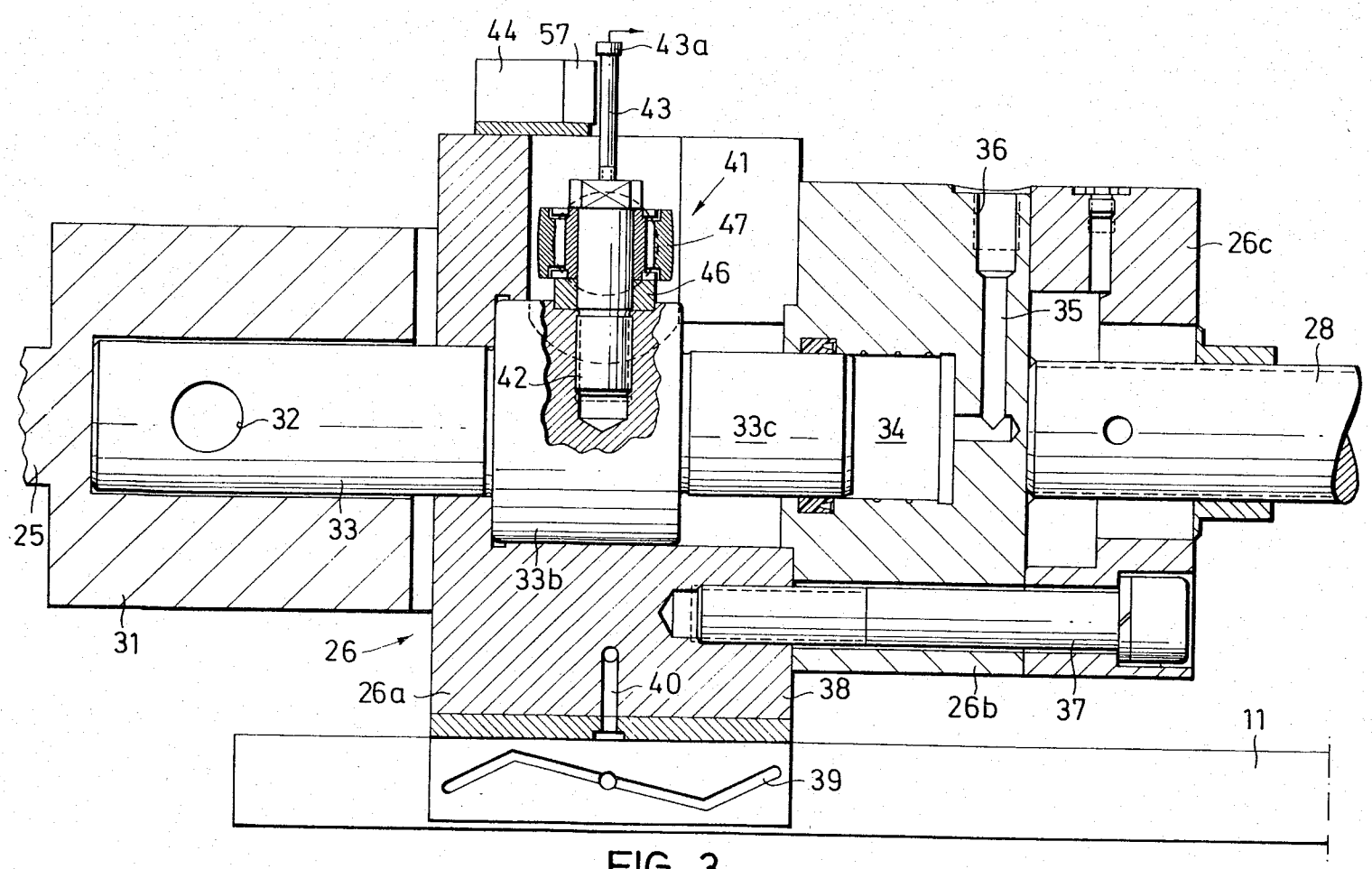
FIG. 3 is a view showing a measuring device of the inventive pipe bending machine, in vertical section.
Figure 4:
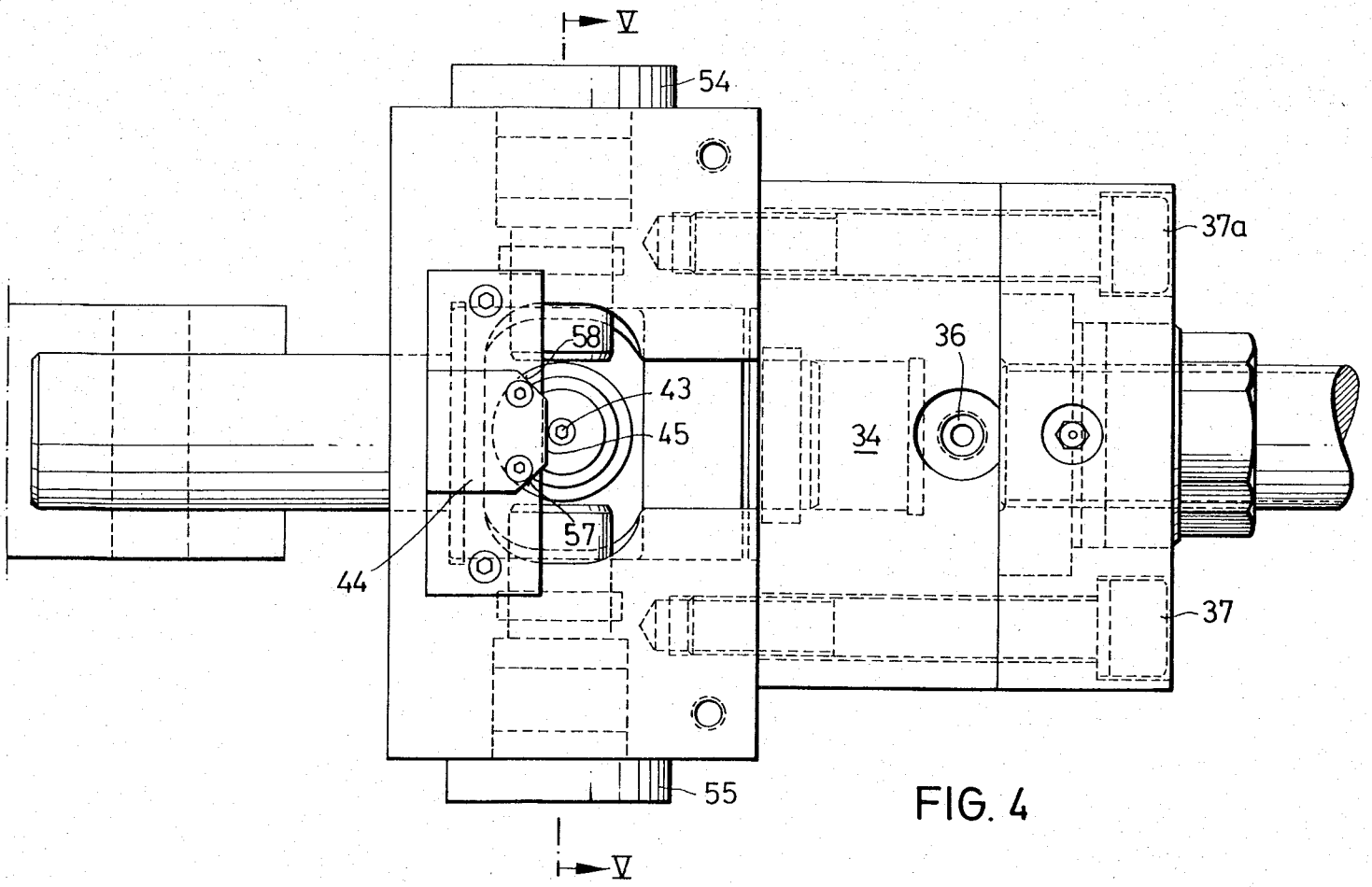
FIG. 4 is a view showing the measuring device of FIG. 3 on plan view from above.
Figure 5:
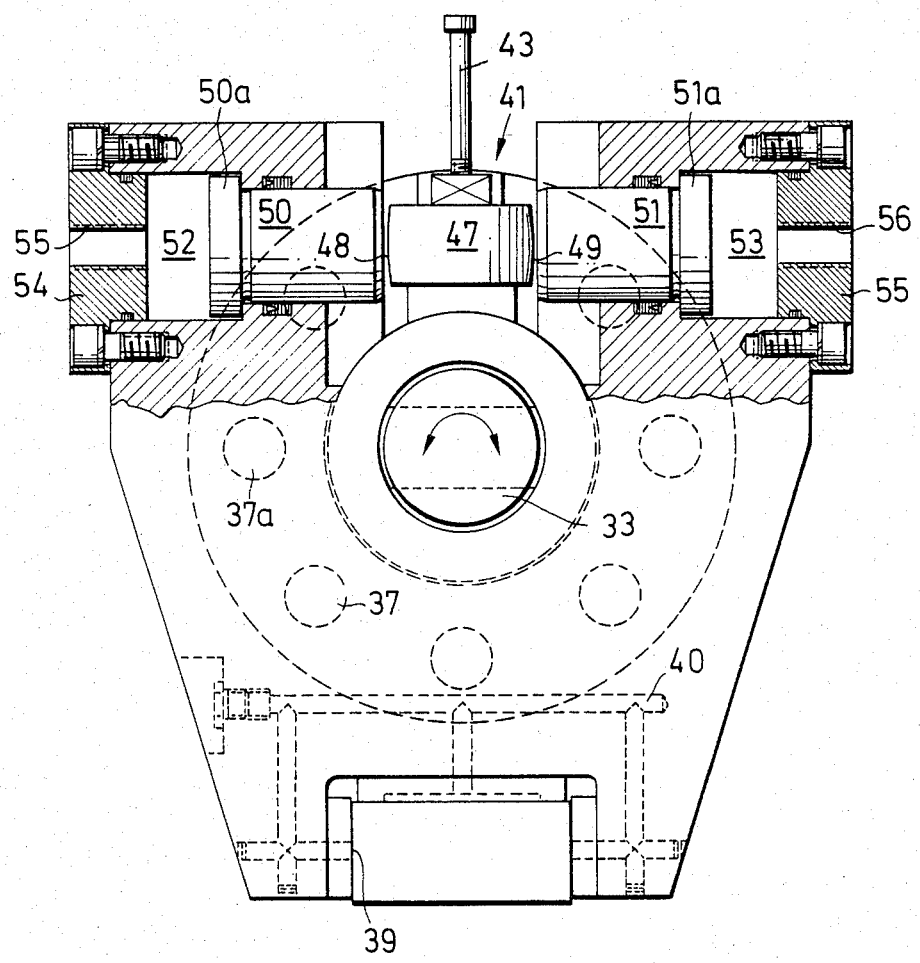
FIG. 5 is a view showing the measuring device of FIGS. 3 and 4 in cross-section, partially sectioned along the line corresponding to the line IV—IV in FIG. 4.

FIGS. 3–5 show an especially advantageous arrangement for determination and evaluation of an overloading of the mandrel or the mandrel rod. The mandrel rod 25 is connected at its rear end with a mandrel bushing 31. The mandrel bushing is formed as a coupling element. It has a radial opening 32. The bushing overlaps a piston 33 which is also provided with a radial opening. Therefore, a force-locking connection between the bushing 31 and the piston 33 can be provided by insertion of a pin into two openings coinciding with one another. The piston 33 is first supported in its central region **33*b* in a measuring housing section 26*a*. The piston 33 has a rear region 33*c* which engages in a cylinder chamber 34 arranged in a housing part 26*b*. The cylinder chamber 34 is provided with a passage 35 which communicates with the connection 36, so that the cylinder chamber 34 is available for an adjustable oil pressure. This adjustable oil pressure is carried out by known means, for example, respective pressure valves. A housing ring 26*c* is flanged on the housing part 26*b* by screws 37 and 37*a*. The piston rod 28 is mounted in the housing ring 26*c*. For guaranteeing the displacement of the measuring housing, it is provided with a carriage 38 and is provided for simplifying sliding movement with a plurality of lubrication passages 39 and 40**.

The central region **33*b* of the piston has a diameter which is greater than the diameter of the front region 33*a* and the rear region 33*c*. A radially extending unit 41 is provided on the central region 33*b* of the piston and forms a part of a switching element. A radially projecting piston 42 is provided in the unit 41 and extended at its upper end by a threaded pin of a smaller diameter 43. The threaded pin is formed as a pin of a contactless end switch 44, such as for example manufactured by the Turck Company. This end switch is also shown in FIG. 4. It has a flat surface 45 extending in the radial plane of the piston. It should be mentioned that the shaft of the threaded pin 43 does not abut on this surface 45 also in the initial position, as can be seen from FIG. 3. FIG. 4 shows an imaginary position which is, however, not available since a hat 43*a* of the threaded pin is above the above mentioned surface 45**.

In the zero position in which no upsetting force or no significant upsetting force is applied upon the mandrel rod or all forces act in plastic or elastic regions, the pin 43 is associated with the surface 45 at such a distance that a neutral position is available. In other words, the movement toward pipe bending is carried out. When however a significant upsetting force which has an inherent danger of damaging with causing subsequent damages is applied to the mandrel rod and from it via the mandrel bushing 31 to the piston 33, the piston region **33*c* overcomes the counterpressure formed by the oil pressure in the cylinder chamber 34. As a result of this the piston is displaced into the cylinder chamber 34 by such a distance or in other words axially displaces that the pin 43 displaces away from the surface 45** of the end switch by such a distance that the neutral condition is lifted and a signal is produced. This signal, for example, given into the control, releases then the steps which eliminates the axial overloading on the mandrel rod.

The abovementioned pin 43 is provided with a spacer ring 46 and carries a support roller 47 which is shown in particular in FIG. 5. The support roller has two oppositely located surfaces 48 and 49, and pistons 50 and 51 are associated with the respective surfaces. The pistons 50 and 51 have heads **50*a* and 51*a* with a diameter increasing in stepped manner. Associated cylinder chambers 52 and 53 are stepped respectively. The increase of the diameter of the heads and the cylinder chambers acts so that the pistons do not displace beyond a predetermined distance in direction toward the support roller 47, so that an exactly maintained gap between the surfaces 48 and 49 of the support roller and the associated opposite head ends of the pistons 50 and 51** is maintained.

The cylinder chambers 52 and 53 are closed from outside by collars 54 and 55 screwed thereon. They have connections 55 and 56 provided with a thread so as to provide for a connection to a oil pressure. The cylinder chambers are also provided with an adjustable oil pressure. When a torsion force having a magnitude exceeding a predetermined value takes place, for example during rotation of the pipe by clamping the mandrel at the inner wall of the pipe, and is applied to the mandrel or via the same to the mandrel rod, either the surface 48 abuts against the piston 50 or the surface 49 abuts against the piston 51 depending upon the direction of rotation. When the thus applied force overcomes the adjusted counterpressure, the pin 43 moves in a circumferential direction. A movement by a small distance provides no change, as can be seen from FIG. 4. It is clear from this Figure that the surface 45 has in the radial plane a certain length which can be changed by exchange of the respectively dimensioned end switches. The contactless end switch has inclined edge surfaces 57 and 58. When by rotation of the piston 33 about its longitudinal axis, the pin 43 leaves the region of the surface 45, the release of a signal will take place. This signal leads then in connection with the measures store in the control to elimination of a further overloading of the mandrel rod.

It will be understood that each of the elements described above, or two or more together, may also find a useful application in other types of constructions differing from the types described above.

While the invention has been illustrated and described as embodied in a pipe bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pipe bending machine, comprising a travelling carriage provided with first clamping means; a bending template provided with second clamping means; a bending mandrel arranged in a pipe to be bent adjacent to said bending template, and having a mandrel rod having a rear end; means connected with said rear end of said mandrel rod for withdrawing said mandrel from said pipe; measuring means connected with said rear end of said mandrel rod for determining both the axial and rotary or torsion loading of said mandrel rod; and a switch element arranged to be actuated by said measuring means in the event that either the axial or torsion loading exceeds a predetermined value to at least stop either axial or torsional overloading of said mandrel for via said switch means.

2. A_pipe bending machine as defined in claim 1, wherein said first clamping means of said travelling carriage is formed as a clamping sleeve.

3. A pipe bending machine as defined in claim 1, wherein said second clamping means of said bending template includes a clamping jaw and a slide rail located adjacent to the latter.

4. A pipe bending machine as defined in claim 1, wherein said mandrel rod has a rear end, said withdrawing means including a cylinder-piston unit cooperating with said rear end of said mandrel rod for withdrawing said mandrel.

5. A pipe bending machine as defined in claim 1, wherein said measuring means includes a housing which supports said rear end of said mandrel rod, and at least cylinder-piston unit for measuring the force applied onto said mandrel rod.

6. A pipe bending machine as defined in claim 5, wherein said mandrel rod has an axis, said cylinder-piston unit having a piston extending in an axial direction of said mandrel rod and a cylinder chamber connected with a pressure source; and further comprising a connecting element which connects said rear end of said mandrel rod with said piston of said cylinder-piston unit.

7. A pipe bending machine as defined in claim 6, wherein said connecting element which connects said rear end of said mandrel rod with said piston is formed as a bushing.

8. A pipe bending machine as defined in claim 6, wherein said cylinder chamber has a changeably adjustable pressure.

9. A pipe bending machine as defined in claim 6 wherein said piston has a front portion exbanding outwardly beyond said housing and connected with said mandrel rod and a rear portion extending into said cylinder chamber connected with said pressure source, said switch element including a switch arranged in said housing, and said measuring means including a sensor which is arranged on said piston and cooperates with said switch.

10. A pipe bending machine as defined in claim 9, wherein said switch is formed as an end switch, said sensor extending on said piston in its radial direction and cooperating with said end switch.

11. A pipe bending machine as defined in claim 10, wherein said end switch is formed as a contactless end switch.

12. A pipe bending machine as defined in claim 1, wherein said mandrel rod has an axis, said measuring means including a housing which supports said mandrel rod, an axially extending piston connected with said mandrel rod and having a central region, a radially extending element provided on said piston, and two cylinder-piston units extending in a radial plane at two opposite sides of said element and associated therewith.

13. A pipe bending machine as defined in claim 12, wherein said cylinder-piston units have cylinder chambers provided with an oil conduit for an adjustable pressure.

14. A pipe bending machine as defined in claim 13, wherein each of said pistons having an end facing toward the respective cylinder chamber and provided with an increased diameter, each of said cylinder chambers being formed respectively stepped and having two different diameters.

15. A pipe bending machine as defined in claim 12; and further comprising a single pin associated with said piston for axial movement and rotary movement and cooperating with said switch element which is formed as an endless switch.

16. A pipe bending machine as defined in claim 15, wherein said contactless end switch has a surface extending in a radial plane of said piston and two surfaces inclined toward said first-mentioned surface so as to form a broken edge.

17. A pipe bending machine as defined in claim 1, wherein said withdrawal means include a cylinder-piston unit having a piston rod, said measuring means having a housing with an end which faces away from said mandrel rod and is provided with a holder for said piston rod of said cylinder-piston unit of said withdrawal means.

18. A pipe bending machine as defined in claim 1, wherein said measuring means including a housing and a cylinder-piston unit with a cylinder chamber and a piston provided with a pin, said withdrawal means including a further cylinder-piston unit with a piston rod, said housing being formed of three parts of each a first part accommodates said piston with said pin, a second part accommodates said cylinder chamber, and a third part accommodates said piston rod.

19. A pipe bending machine as defined in claim 1, wherein said measuring means includes a housing which supports said rear end of said mandrel rod, and at least cylinder-piston unit for measuring the force applied onto said mandrel rod, said cylinder-piston unit having a piston extending in an axial direction of said mandrel rod and a cylinder chamber connected with a pressure source; a connecting element which connects said rear end of said mandrel rod with said piston of said cylinder-piston unit.

* * * * *